United States Patent [19]

Jackle, III et al.

[11] Patent Number: 4,730,741

[45] Date of Patent: Mar. 15, 1988

[54] PRESSURE-FEED TRAY SYSTEM

[75] Inventors: William C. Jackle, III, Scottsdale, Ariz.; Richard A. Sherwood, Dallas, Tex.; Frederick M. Avery; James V. Seifert, both of Phoenix, Ariz.

[73] Assignee: The Niven Marketing Group, Des Plaines, Ill.

[21] Appl. No.: 920,042

[22] Filed: Oct. 16, 1986

[51] Int. Cl.[4] ..... A47F 7/00

[52] U.S. Cl. ..... 211/59.3; 312/71

[58] Field of Search ..... 211/59.3, 59.2, 59.4; 312/45, 71; 24/128; 221/271, 279; 206/556

[56] References Cited

U.S. PATENT DOCUMENTS

| | | | |
|---|---|---|---|
| 2,098,844 | 11/1937 | Waxgiser | 211/59.3 |
| 2,110,299 | 3/1938 | Hinkle | 211/59.3 |
| 2,129,122 | 9/1938 | Follett . | |
| 2,668,648 | 2/1954 | Carlsen | 211/59.3 X |
| 2,769,551 | 11/1956 | Just . | |
| 3,008,583 | 11/1961 | Lindell . | |
| 3,083,067 | 3/1963 | Vos et al. | 312/71 |
| 3,161,295 | 12/1964 | Chesley | 211/59.3 |
| 3,348,732 | 10/1967 | Schwarz . | |
| 3,452,899 | 7/1969 | Libberton . | |

*Primary Examiner*—Ramon S. Britts
*Assistant Examiner*—Sarah A. L. Eley
*Attorney, Agent, or Firm*—Ralph R. Rath

[57] ABSTRACT

A dispensing unit includes a tray system including front, rear and side walls with partitions dividing the system into a plurality of trays and a support slidably supporting the tray system between a product dispensing position and a product restocking position. Each tray has a slot in its bottom between the front and rear walls with a pusher plate slidably supported in the slot and biased toward the front wall. The support has a stop which moves all of the pusher plates toward the rear wall when the tray system is moved to the restocking position and a latch mechanism holds the tray in the product dispensing position.

27 Claims, 30 Drawing Figures

5
5
86
88
92
94
96
82
86
46
42
70
62
48
88
44
76
50
78
80
62
62a
70
66
66a
82
86
94
50
76
78
74
72
66
58
80
81
58
64
64
62
60
74
72

PRESSURE-FEED TRAY SYSTEM

TECHNICAL FIELD

The present invention relates generally to dispensing devices and, more particularly, to a pressure-feed tray system which allows for easy access for restocking of the product with proper stock rotation.

BACKGROUND PRIOR ART

Shelving is used extensively for stocking various items for display at the point of purchase. For example, in grocery stores fixed shelving is used extensively for supporting merchandise for display. In recent years, most stores have fixed shelving arranged in a back-to-back relation with a common rear wall so that the products are displayed towards aisles located on opposite sides of the shelving.

For many grocery products and other related items, the product is dated and usually is removed from the shelf after the expiration date for the particular product. Thus, in restocking of the product, it is necessary to place the fresher stock at the rear of the display so that the older product will be removed first via purchase. This usually involves the removal of the older stock and the replacement of new stock and subsequent replacement of the older stock, which is a time consuming operation. Also, most times in stores, there is no alternate space for storing the removed stock while the new stock is being placed on the shelves. Thus, many times the old stock is placed on the floor while the new stock is being replaced, which can create some health problems and is also an inconvenience to shoppers since the aisles may be cluttered with product.

In order to devise a means for automatically moving the product to the front of the display, it has been proposed to use a gravity-feed type of stock supply in the shelving so that the new product can be inserted behind any existing product on the shelf. An example of such display and delivery stand is disclosed in U.S. Pat. No. 2,769,551. Such a system is acceptable if the product is relatively heavy so that it will automatically move towards the front of the display when an article is removed. However, if the product is light, such as in small snack foods or potato chips, gravity-feed is not very practical.

It has also been proposed to provide a biasing means which will automatically force the packages into an upright position at the front of the rack. For example, in the display of bags of potato chips, U.S. Pat. No. 3,008,583 discloses a device wherein the spring-biased follower automatically moves the stack of bags towards the front of the display. Such an arrangement has drawbacks in that the system requires a hook arrangement adjacent the rear of the display so that the follower can be moved and held to the rear of the display for restocking. However, access to the rear of the rack is seldom available in modern-day displays, particularly in grocery stores or other places. This is particularly true when the product being displayed is rather large, such as potato chip bags, which are stocked on a fixed shelf. Furthermore, potato chips are very fragile and will have a tendency to crumble each time a bag is handled.

SUMMARY OF THE INVENTION

According to the present invention, a pressure-feed tray system has been developed which can be moved from the product dispensing position to a product restocking position and wherein all of the pressure plate members are automatically moved to the rear of the trays when the tray system is moved to a restocking position. Such rearward movement of the pressure plates allows new stock to be positioned behind the existing older stock on the shelf, and the pressure-feed plates will automatically bias the stock towards the front of the tray when the tray is returned to the first display position.

More specifically, the product dispensing apparatus of the present invention includes a fixed support means and a tray slidably supported on the support means and movable from a product dispensing first position substantially coextensive with the support means to a second product replenishing position extending away from said support means. The tray has a front end and a rear end and guide means extending along the bottom portion of the tray between the front and rear ends. Pusher plate means are slidably mounted on the guide means and biased towards the front end with stop means on the support means for moving the pusher plate means to the rear end of the tray when the tray is moved from the dispensing position to the restocking position so that new stock can be introduced behind the existing stock on the tray.

In the preferred embodiment, the dispensing apparatus consists of a tray system that has a front end and a rear end and side walls with partitions extending between the front and rear ends to define a plurality of trays. Each tray has a slot along the bottom wall that supports the pusher plate which is biased towards the front end by spring means located between the support and each pusher plate. In an alternate embodiment, the support means consists of a rear cross-bar having a plurality of guide means extending forwardly therefrom with the tray system consisting of a plurality of trays supported on the guide means adjacent opposite side walls. Each tray has an elongated slot aligned with the guide means with the pusher plates being supported on the guide means.

In a further embodiment, the product dispensing apparatus includes a fixed support having a tray system slidably supported thereon with the tray system consisting of front and rear walls and side walls with the front and rear walls having slot means and partitions extending between the front and rear walls to divide the tray system into a plurality of trays. In this embodiment, a guide bar also has projections on opposite ends which are received into the slot means and slidably support a pusher plate which is biased towards the front wall. Again, all of the pusher plates are moved towards the rear of the tray system when the tray system is moved to a restocking position. The slot means in this embodiment may be in the form of a continuous slot or a plurality of spaced holes or openings. In the preferred form, bottom wall segments are provided on opposite sides of the guide bars and have projections received into the slot means with the wall segments having openings on opposite ends that receive projections on opposite ends of the partitions.

In all embodiments, a latch mechanism is provided for maintaining the tray system in a dispensing position on the support.

BRIEF DESCRIPTION OF SEVERAL VIEWS OF DRAWINGS

DETAILED DESCRIPTION

Figure 1:
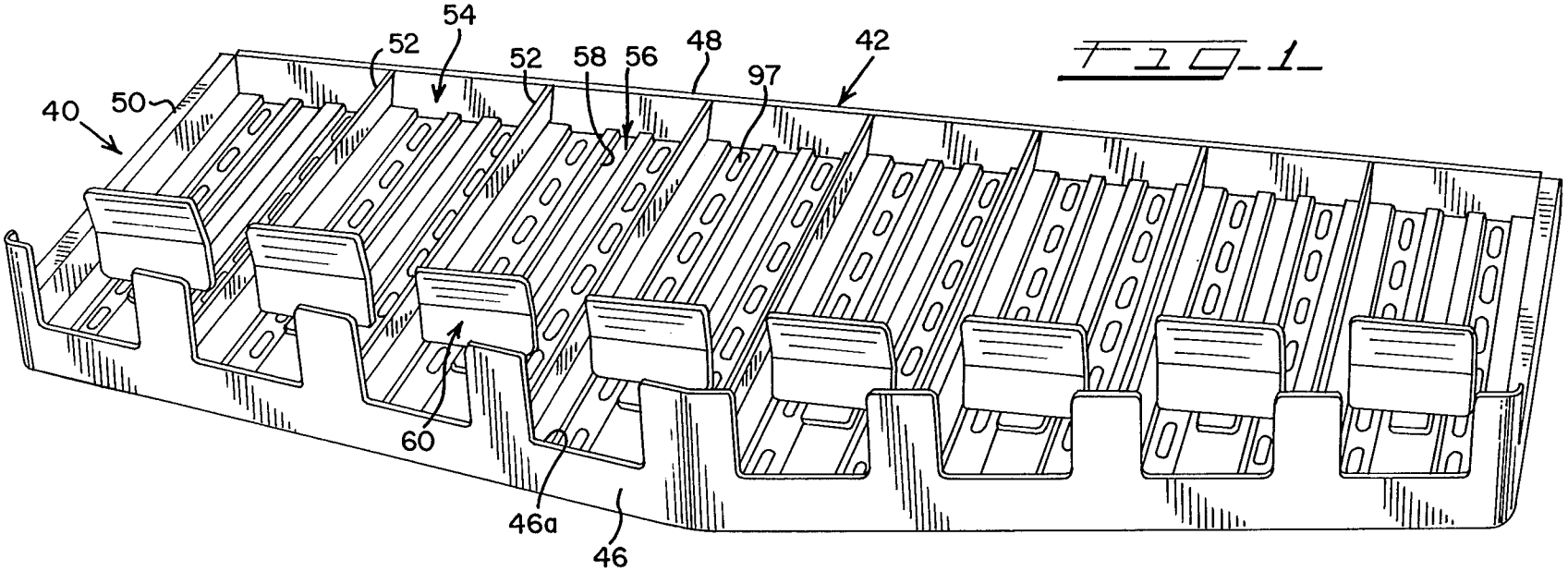
FIG. 1 is a perspective view of the preferred form of the product dispensing apparatus constructed in accordance with the present invention.
Figure 5:
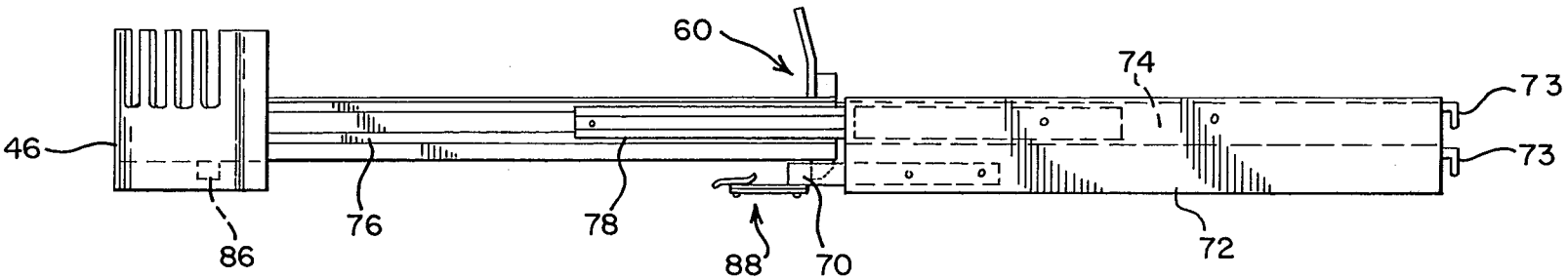
FIG. 5 is a side view as viewed along line 5—5 of FIG. 4.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
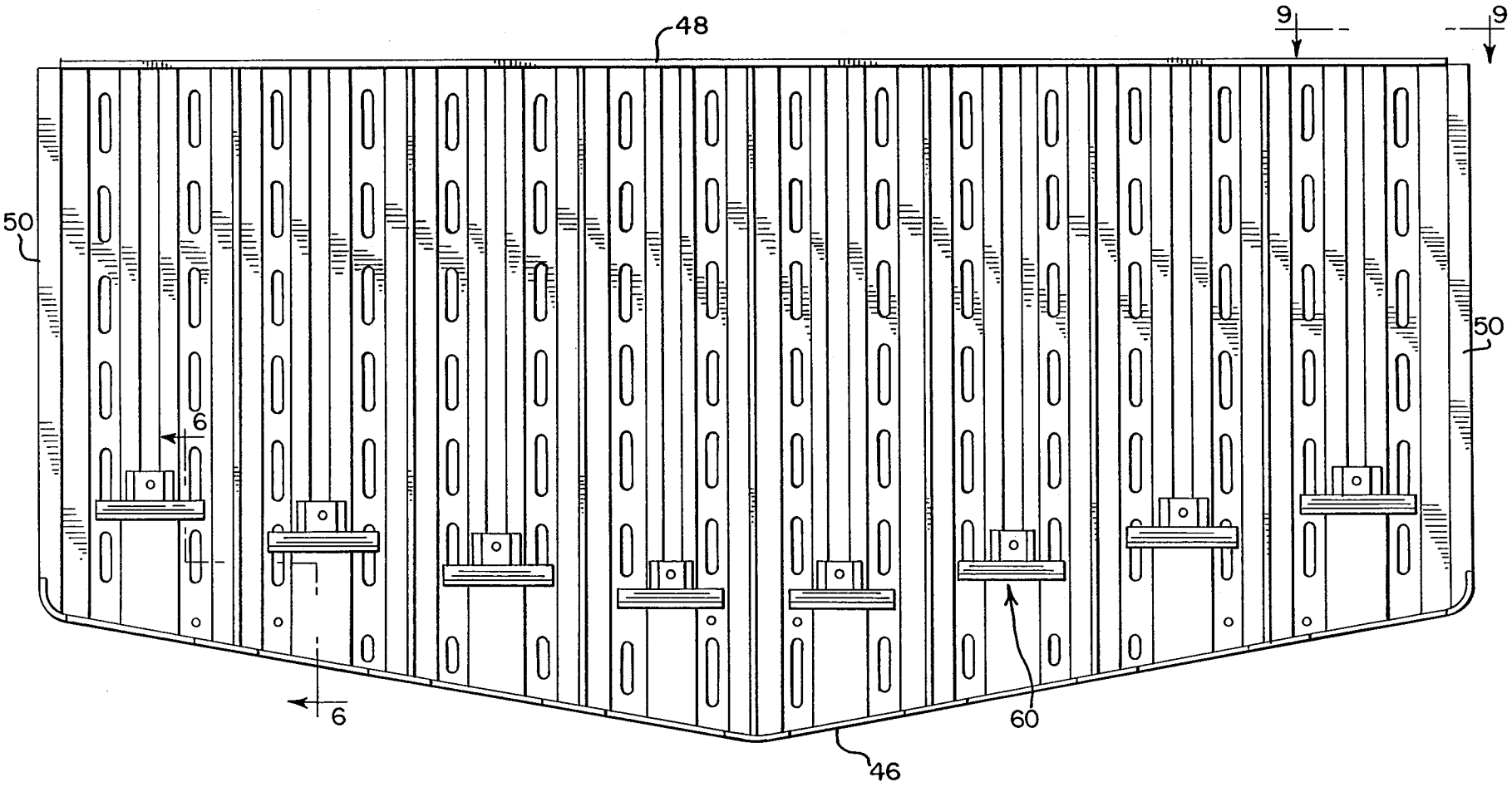
FIG. 2 is a top view of the apparatus shown in FIG. 1.
Figure 3:
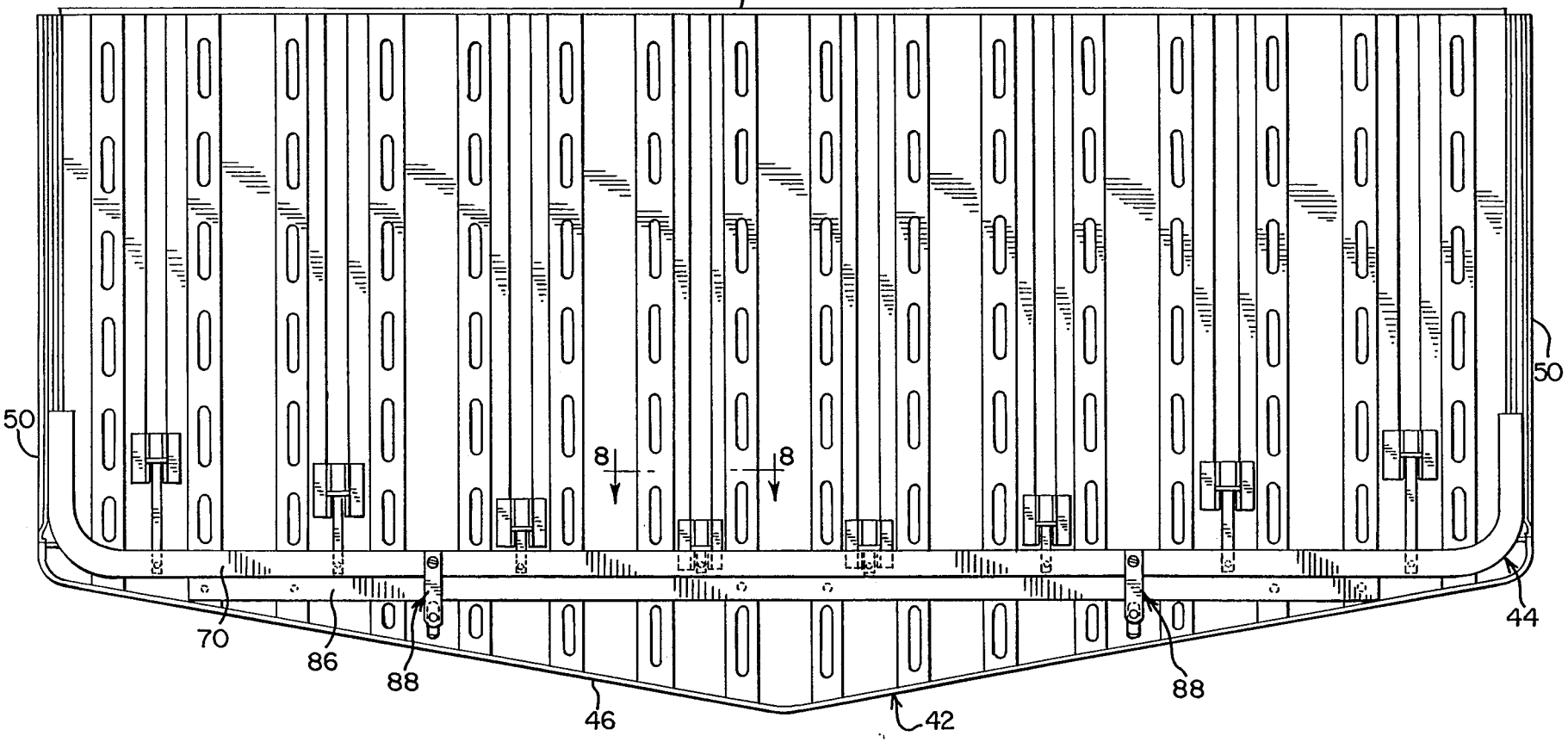
FIG. 3 is a bottom view thereof showing the apparatus in a product dispensing position.

FIGS. 1-9 disclose a product dispensing apparatus, generally designated by reference numeral 40, consisting of a tray system 42 supported on a support means 44 (FIG. 3). In this embodiment, the tray system consists of a member that has a slightly tapered front wall 46, a rear wall 48 and side walls 50. A plurality of partitions 52 divide the tray system into a plurality of individual trays 54. Each tray has an elongated slot 56 extending between the front and rear walls 46 and 48 with the slot having opposite edges 58. A pusher plate means 60 (FIG. 8) is slidably supported on the edges 58 of the slot 56 and has a base 62 which has outwardly-extending flanges 64 that engage above and below the edges 58 for guiding the pusher plate along the slot 56. The pusher plate means also includes a plate 66 that extends above the base 62. The plate 66 has an upper forwardly-inclined portion 66*a* (FIG. 6), for a purpose that will be described later.

Figures 4, 6, 7, 8, 9:
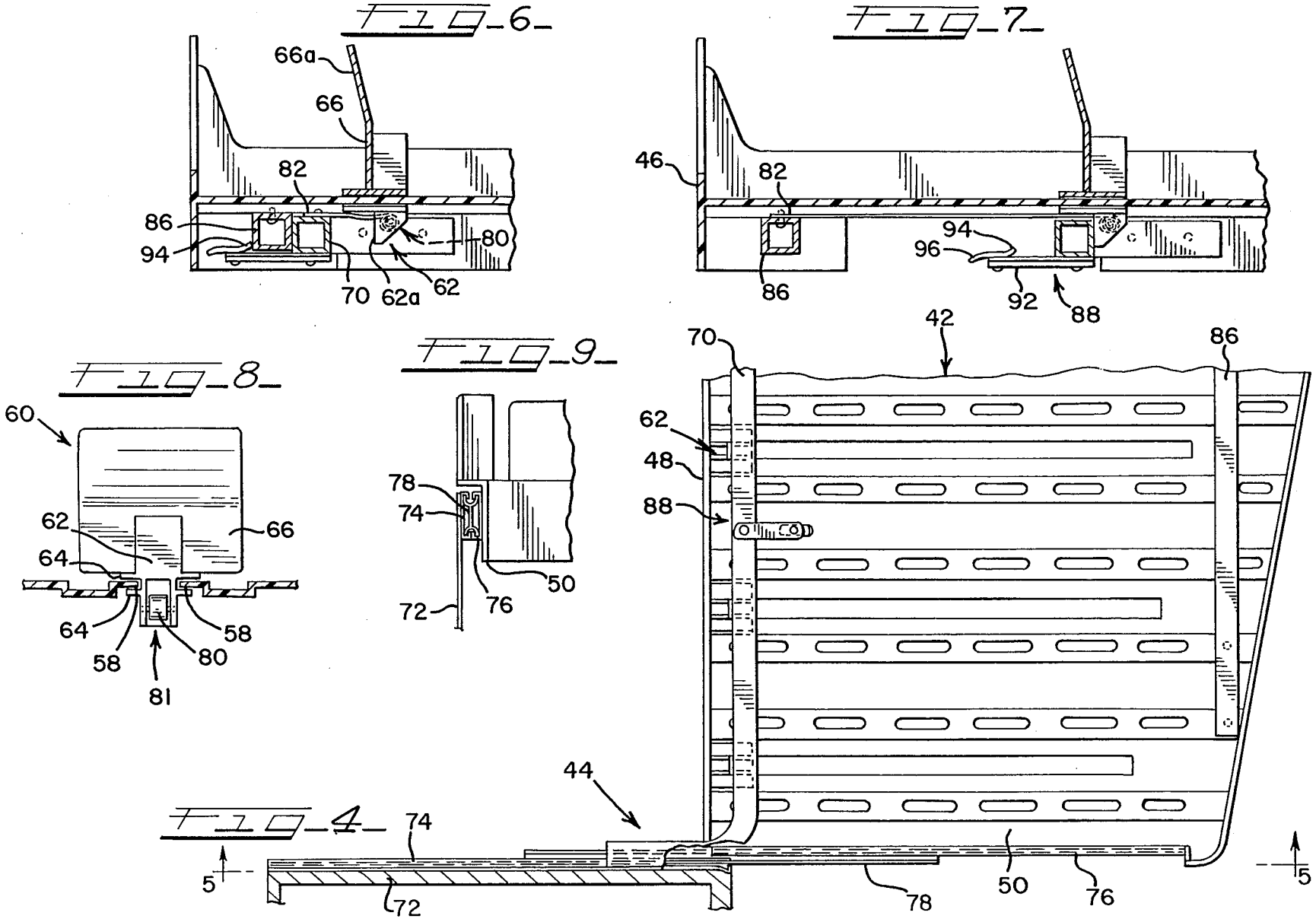
FIG. 4 is a fragmentary bottom view of the apparatus with the tray system in a product restocking position.
FIG. 6 is a fragmentary cross-sectional view as viewed along line 6—6 of FIG. 2
FIG. 7 is a fragmentary cross-sectional view similar to FIG. 6 with the spring partially extended.
FIG. 8 is a fragmentary cross-sectional view as viewed along line 8—8 of FIG. 3.
FIG. 9 is an end view of the track support for the tray system as viewed along 9—9 of FIG. 2.

As illustrated in FIG. 4, the support means consists of a cross-bar or transverse member 70 that has a pair of fixed support plates 72 extending rearwardly on opposite ends thereof with the plates 72 located outside the side walls 50 of the tray system 42 and the plates have hooks 73 (FIG. 5) for connection to a slotted gondola structure (not shown). The support plates 72 carry a fixed track 74 and the side members or side walls 50 carry a track 76 with a movable guide track 78 located between the two tracks. As a result, the side wall 50 is slidably supported on the rail or plate 72 and is movable from the position in FIG. 1 to the position shown in FIG. 4. Tracks 74, 76, 78 are designed to allow for transverse movement of the plates 72 to accommodate varying distances in mounting configuration.

According to one aspect of the present invention, the dispensing apparatus includes biasing means for biasing all of the pusher plate means 60 towards the front wall, as illustrated in FIG. 2. The biasing means is shown in FIGS. 6 and 8 and consists of a coil spring 80 supported in a socket 81 in the base 62 with a free end 82 of the coil spring 80 connected to cross-bar or member 70 of the support 44. The coil spring 80 is preferably a constant-force spring which could alternatively be carried by the cross-member 70 and have its free end 82 supported on the base 62. Thus, the coil springs or biasing means 80 bias all of the pusher plate means 60 to the forward end of the slots 56, as illustrated in FIG. 1.

According to one further aspect of the invention, the dispensing apparatus also has latch means for latching the tray system in the dispensing position on the support means. As shown in FIGS. 6 and 7, the tray system has an abutment in the form of a hollow rectangular tube 86 adjacent the front wall 46 and the cross-bar 70 supports a latch mechanism 88. The latch mechanism preferably consists of a cantilevered member extending towards the abutment 86. The cantilevered member includes a spring steel element 90 and a resilient plastic element 92 that overlap each other. A hook member 94 is secured to the free end of the cantilevered member and has an inclined ramp or surface 96. While two transversely-spaced latches have been shown, it is apparent that only one latch is necessary.

Considering now the structure so far described, the tray system is normally in the position shown in FIGS. 1 and 3 wherein the tray system 42 is secured in this position by the hooks 94 engaging the abutment 86 and all of the pusher means 60 are biased towards the front wall 46 into engagement with forward ends of the slots 56. If a product to be displayed, such as potato chips, is located in any of the trays, the pusher plates will engage the rearmost product and force all of the products towards the front wall 46. The upper edge of the forwardly-inclined plate 66*a* will tend to grip the potato chip bag between the upper and lower edges to hold the rear-most bag and maintain it in the bottom of the tray. It will be noted that the front wall has cut-outs 46A so that the majority of the front of the package is exposed for viewing by the purchaser.

When the product is to be restocked, the two latches 88 are released and the tray is pulled forward from the stationary cross-member 70. As the tray is moved outwardly to a restocking position, shown in FIG. 4, the forward abutment 62*a* of base 62 engages the cross-bar 70 and each pusher plate means 60 is held by the cross-bar while the tray is moved to the second restocking position, shown in FIG. 4. During this movement, the coil spring 80 is extended and thereby places a forward force on the pusher means, for a purpose that will be described later.

With the tray system in the second restocking position illustrated in FIG. 4, the new stock may be inserted behind any of the existing stock or product that is in any of the respective trays. After the tray system has been fully restocked, the tray system is returned to the first position shown in FIG. 1 and each of the pusher plate means 60 will engage the rear-most product and force all of the product or article in a particular tray towards the front wall 46. It should be noted that potato chip bags have a generally oval vertical cross-sectional configuration and the inclined portion 66*a* of plates 66 will grip the rear-most bag to maintain it in the tray. When an article is removed from the front of the row of articles appearing in a tray, the pusher plate means 60 will automatically move the remaining articles towards the front wall. This movement will continue until all of the articles have been depleted from a particular tray.

It should be noted that the latch mechanism will automatically slide across the abutment 86 and the spring bias of the spring and plastic member of the resilient cantilevered member 90, 92 will cause the hook 94 to be moved into engagement with the abutment 86. It should also be noted that the latch mechanism is located in front, directly underneath the front wall to be easily accessible to a stocker for unlatching when restocking is to be done.

Preferably, the tray system is formed as a one-piece molded plastic material and may have selected cutouts or openings 97 formed in the bottom wall to reduce the weight of the tray system, as well as the amount of material required for molding the system. The cutouts 97 facilitate in cleaning of the unit and the respective corners have radiused portions to further facilitate effective cleaning of the unit.

Figure 12:
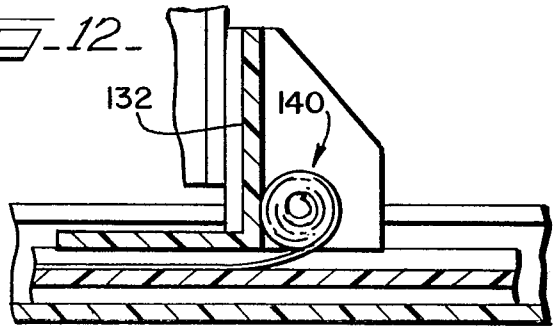
FIG. 12 is a fragmentary cross-sectional view as viewed along line 12—12 of FIG. 10.
Figure 13:
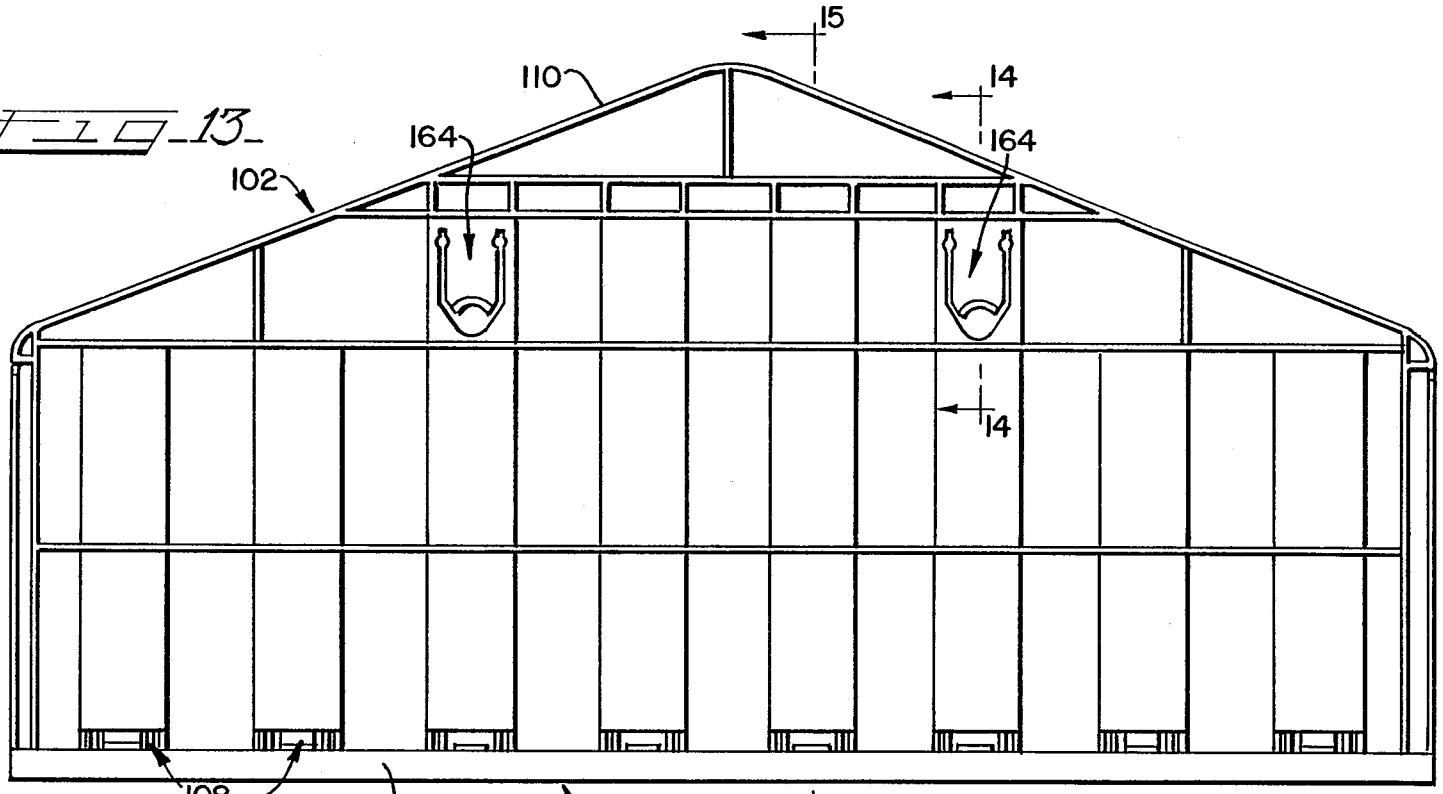
FIG. 13 is a bottom view of the embodiment illustrated in FIG. 10.

A slightly modified form of the invention is disclosed in FIGS. 10–20 which show a product dispensing apparatus 100 consisting of a tray system 102 (FIG. 10) and a support means 104 (FIG. 13). In this embodiment, the support means consists of a cross-bar 106 extending across the rear end of the unit and having a plurality of forwardly-extending guide rails or tracks 108 that extend parallel to each other. The tray system 102 consists of a molded one-piece plastic member that has a front wall 110 which is tapered rearwardly from a peak or center. 112 and side walls 114. The tray system 102 also includes a bottom wall 116 and a rear wall 118 with a plurality of partitions 120 that define a plurality of spaced trays 122 extending parallel to each other. Each of the trays has an elongated slot 124 defined in the bottom wall and the slot is aligned with a guide rail 108 that forms part of the support means. An elongated channel 126 extends below the bottom wall parallel to the slot 124 and surrounds the guide rail 108 which has upwardly-extending ledges 128 to insure adequate clearance for the pusher plate means (described below).

A pusher plate means 130 (FIG. 11) is located in each of the trays and includes a base 132 that extends through the slot 124 and has outwardly-directed flanges 134 that are slidably supported on the guide rails 108. A pusher plate 136 extends above each of the bases 132 and is positioned thereon so that the front face of the plate 134 extends substantially parallel to the inclined front wall 110. The pusher plate 136 has a forwardlyinclined upper portion 137 (FIG. 10) to grip the bag and maintain it in the bottom of the tray.

Figure 10:
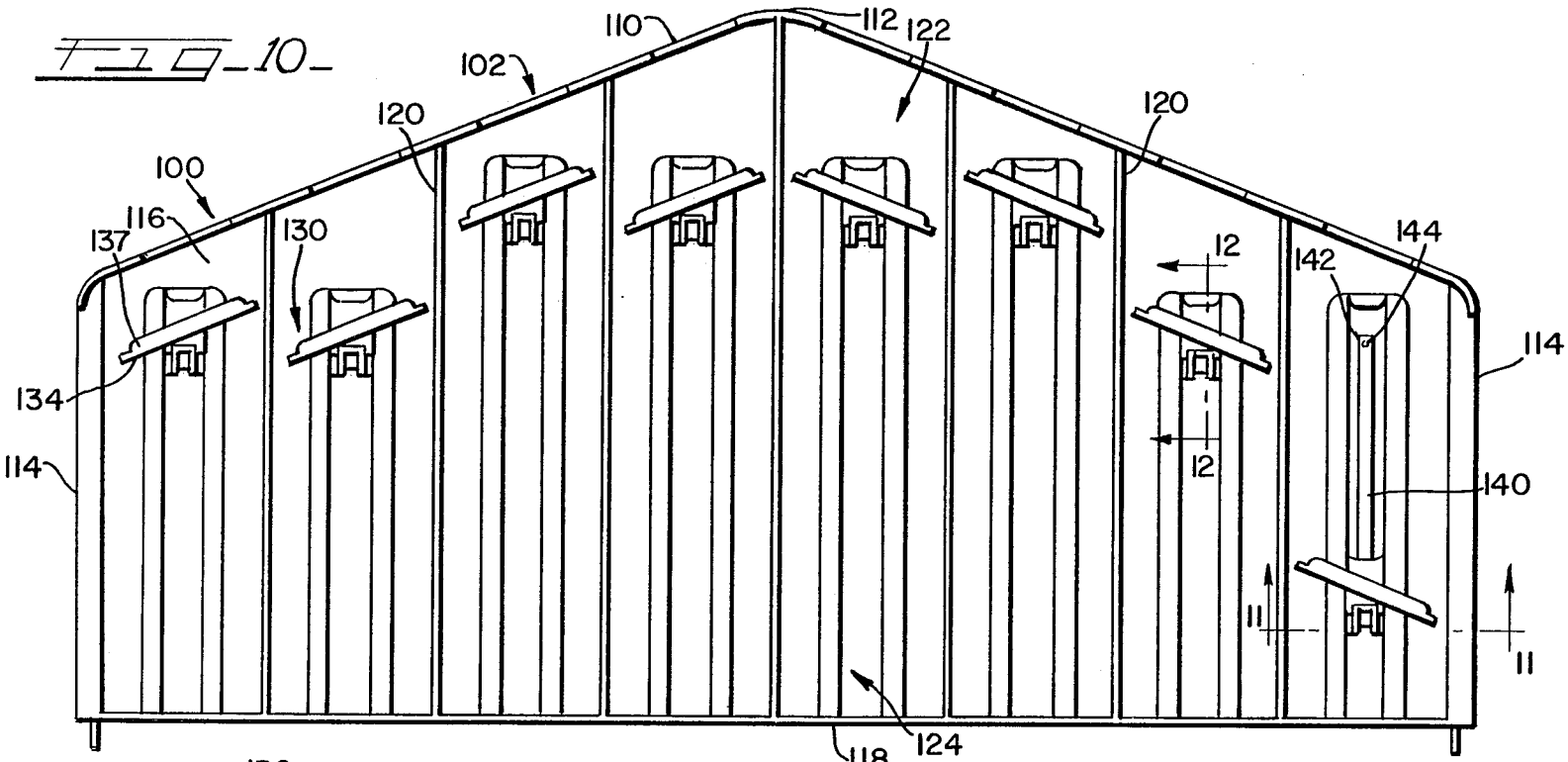
FIG. 10 is a top plan view of a slightly modified form of the dispensing apparatus.
Figure 11:
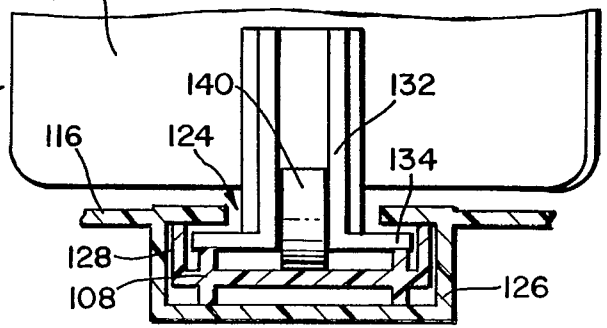
FIG. 11 is a cross-sectional view as viewed along line 11—11 of FIG. 10.

The pusher plate means 130 is again biased towards the front wall 110 by biasing means 140, shown in FIGS. 11 and 12. The biasing means consists of a coil spring which is supported on the base 132 of the pusher plate means 130 and has a free end 142 secured to the outer free end of the guide rail 108 by a fastener or other suitable securing means 144 (FIG. 10). Thus, the biasing means 140 biases the pusher plate means 130 to the forwardmost position, illustrated in FIG. 10.

It will be noted in FIG. 10 that the slots in the two pairs of outer trays adjacent opposite sides 114 are shorter than the slots in the four central trays because of the tapered front wall 110. Thus, provision must be made for accommodating the lesser movement of the outer pusher means with respect to the inner pusher means so that all of the pusher means are located adjacent the rear wall when the tray is moved to a restocking position, as will be described later.

Figure 16:
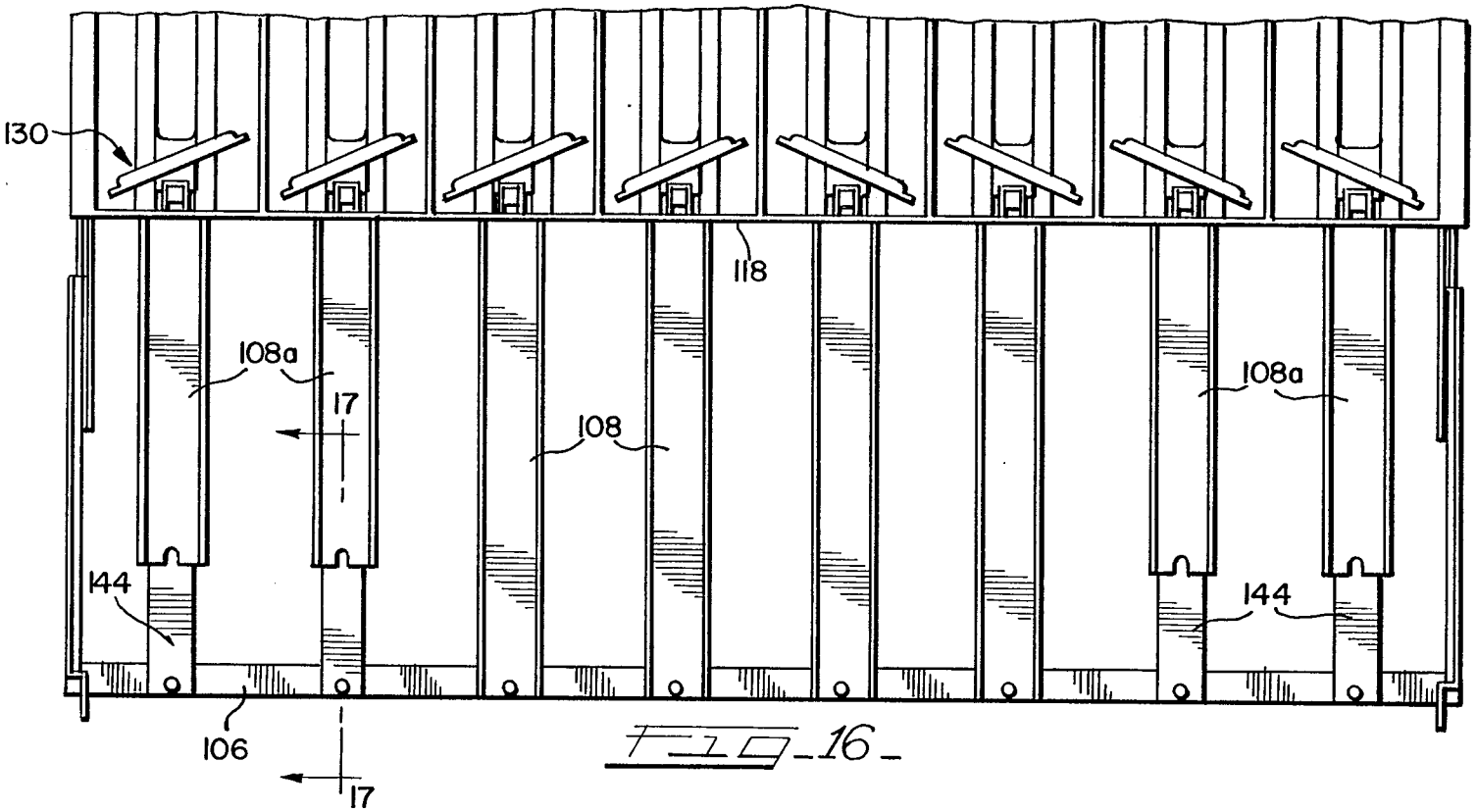
FIG. 16 is a partial top view of the tray system in a restocking position.
Figure 17:
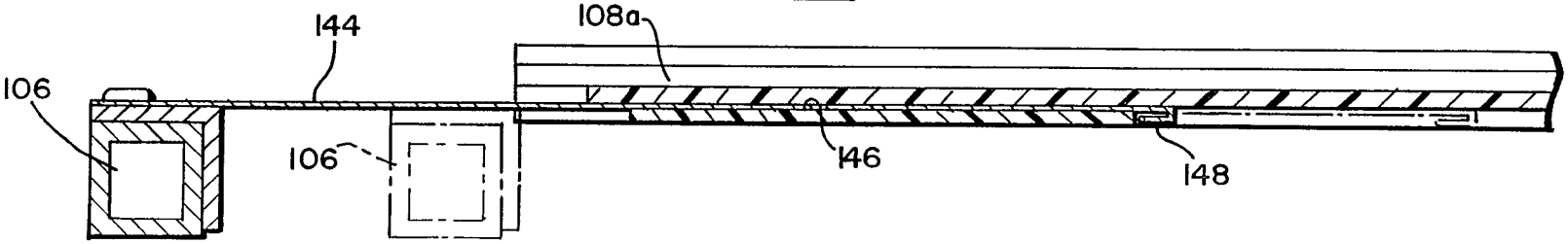
FIG. 17 is a fragmentary cross-sectional view as viewed along line 17—17 of FIG. 16.

As illustrated in FIGS. 16 and 17, the two outer guide rails 108*a* are slidably supported on plates 145 which are secured to the cross-bar or support 106 and extend through a slot 146 defined adjacent the rear end of the guide rail 108*a*. A hook 148 is defined on the end of the plate 145 to limit the forward movement of the guide rail 108*a*, as will be described later.

Figure 19:
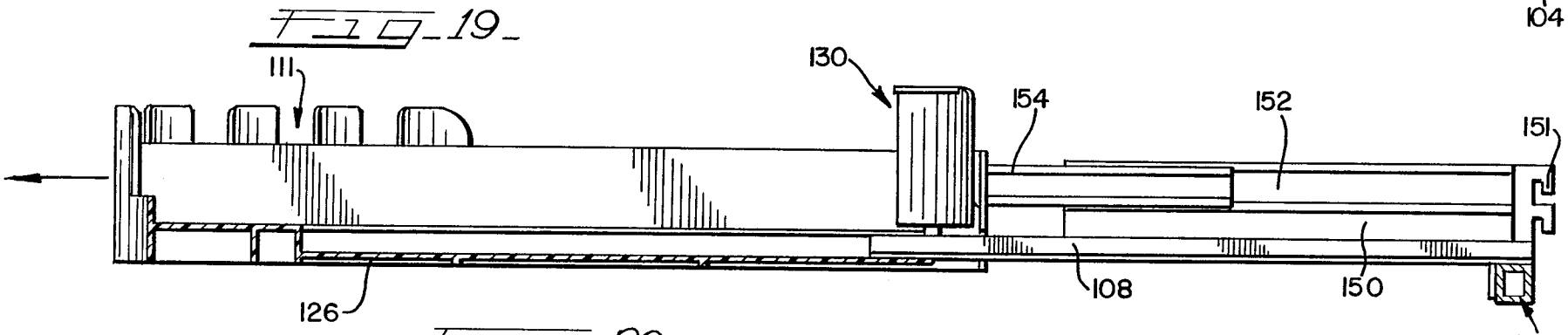

The support means also include a pair of side plates 150 (FIG. 19) that extend forwardly adjacent opposite ends of the cross-bar 106. The plates are located outside the side walls 114 and have supporting hooks 151 on the rear end thereof (FIG. 19). Each plate has a track 152 supported thereon, which slidably receives a track section 154 which is also slidably supported on a track section (not shown) secured to the side wall 114, as described in the previous embodiment.

Figure 15:
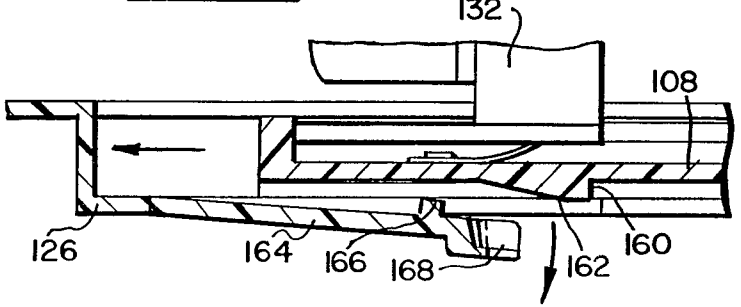
FIG. 15 is a fragmentary cross-sectional similar to FIG. 14 showing the latch mechanism in a released position.
Figure 14:
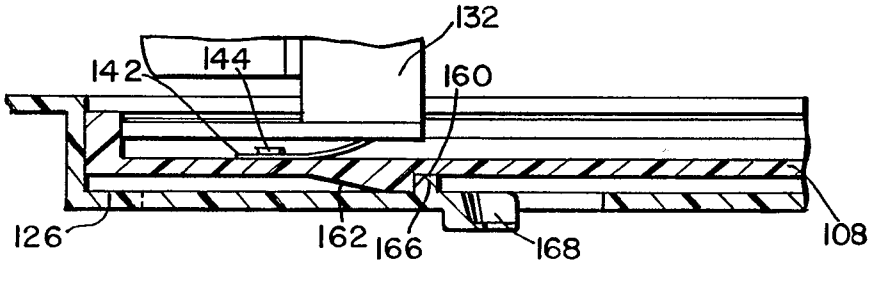
FIG. 14 is a fragmentary cross-sectional view as viewed along line 14—14 of FIG. 13 showing a latch mechanism.

The product dispensing unit 100 also has a latch means for maintaining the tray system 102 in a product dispensing mode on the support 104. As illustrated in FIGS. 14 and 15, the lower surface of guide means 108 has a shoulder 160 defined adjacent the forward end and an inclined ramp 162 extending forwardly of the shoulder 160. A lower portion of a channel 126 has a latch 164 formed integral therewith and the latch has a stop or abutment 166 defined on the upper surface thereof with a gripping means 168 defined on the free end. The inner end of the latch 164 is integral with the bottom wall of the channel 126.

Thus, with the latch in the secured position, shown in FIG. 14, the tray system will be secured in the product dispensing position (FIGS. 10 and 13). When it is desired to restock the tray system, the gripping means 168 of the two latches 164 are pulled downwardly to release the abutment 166 from the shoulder 160. Thereafter, the tray can be pulled forwardly on support 104 to a second restocking position, indicated by the arrow in FIG. 15, which will be described later. When the tray system is then returned to the product dispensing position, the abutment 166 will ride along inclined ramp 162 and the resiliency of the plastic material will allow the latch to flex outwardly until the abutment clears the shoulder at which time the inherent resiliency of the plastic material will move the latch to the position illustrated in FIG. 14. It will be noted that two latches are disclosed, and both are located adjacent the front wall 110 so that they are easily accessible for release from the front of the tray system.

Figure 18:
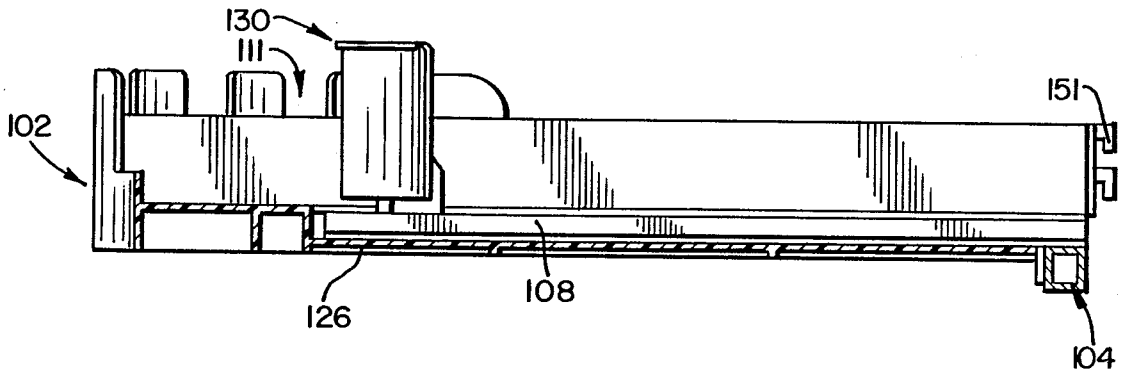
FIGS. 18, 19 and 20 are illustrations of the relative movement between the tray system and the pressure plates on the support, as viewed along line, 15—15 of FIG. 13.
Figure 20:
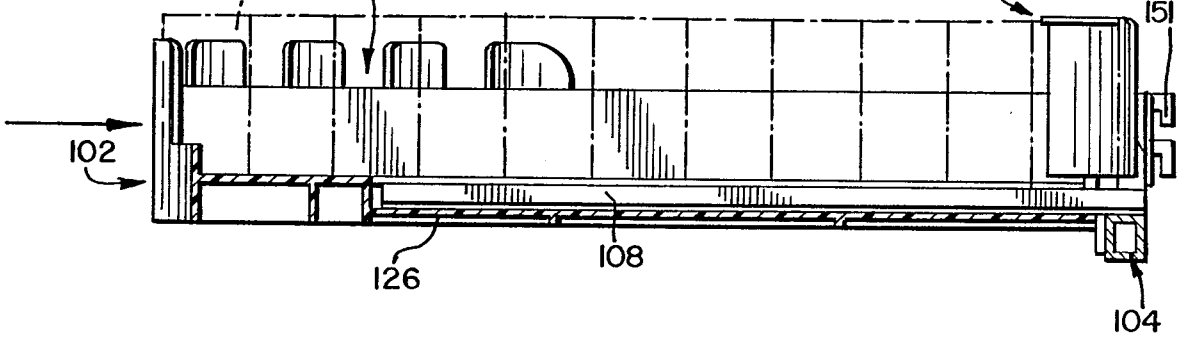
Figure 21:
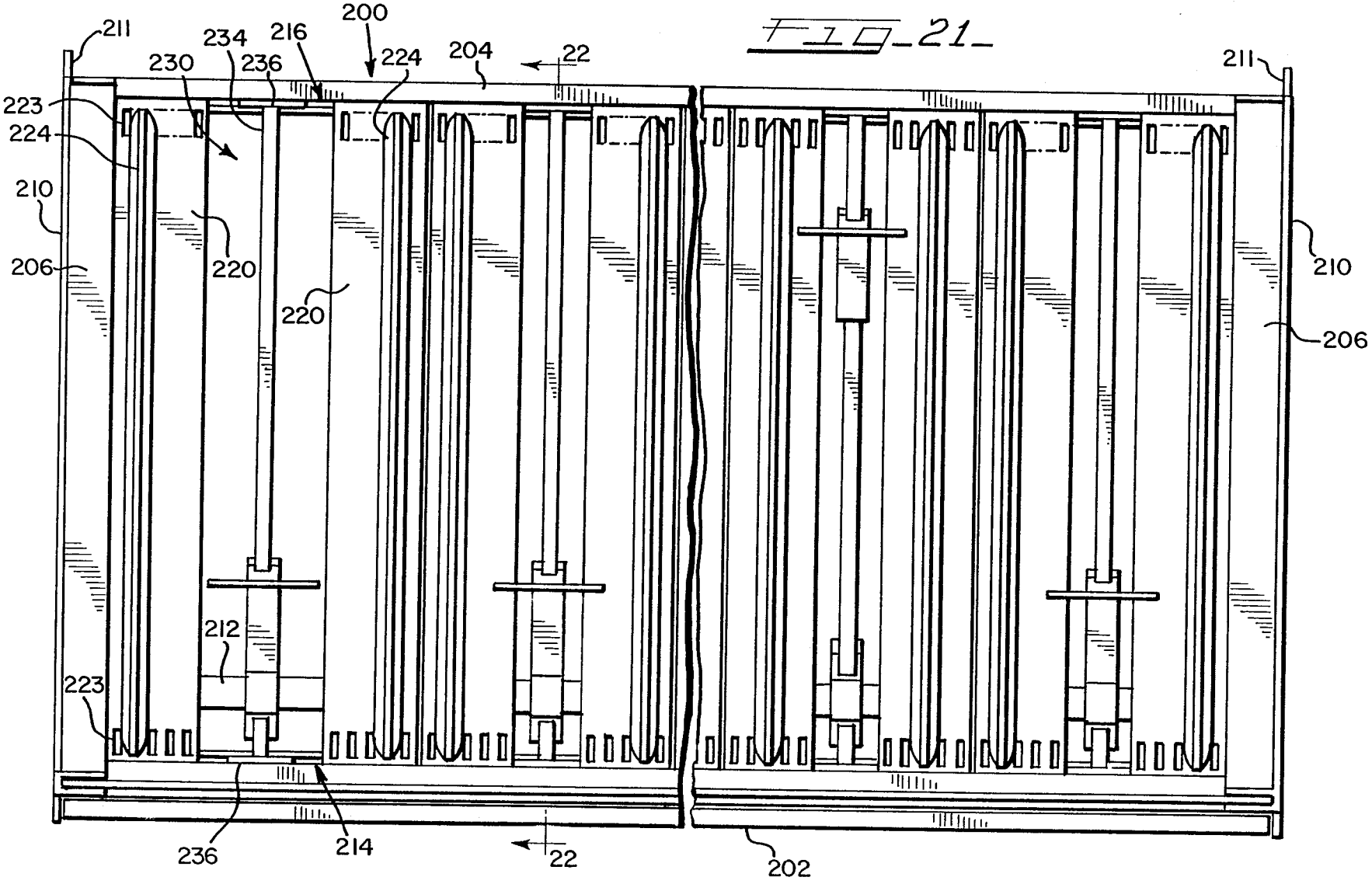
FIG. 21 is a plan view of the further modified form of the invention.

FIGS. 18, 19 and 20 disclose the various positions of the tray system on the support as well as the pusher plate means in the respective positions. FIG. 18 shows the tray system in its empty position, either before restocking or after all of the items have been removed from the tray. It will be noted that the pusher plate means 130 are all located adjacent the forward ends of the slots being biased to this position by the coil springs 140.

When it is desired to restock the dispensing unit, the latches are gripped on the end portions 168 and are released from shoulders 160 and the tray system is pulled forwardly to the position illustrated in FIG. 19. During this forward movement, all of the pusher plate means 130 are moved to the rear wall 118 and ultimately are positioned at the rear end of the respective slots 124. During this forward movement, the outer guide rails 108*a* move forwardly with tray system and slide on plates 144 so that all of the pusher plate means are located adjacent the rear wall, as shown in FIG. 16. The product P to be displayed is then introduced into the respective trays until each of the trays is filled. The tray system is then returned to the product dispensing position, shown in FIG. 20, and during such movement, the pusher means 130 engage the rear-most item on each tray and move rearwardly as the tray system is moved to its product dispensing position (FIG. 20). During the latter portion of this movement, the latches 164 slide along the ramps 162 and engage the stop 160 thereby holding the tray system in a product dispensing position on the support.

In the product dispensing position illustrated in FIG. 20, the coil springs bias the pusher plate means towards the front wall so that when an item P is removed from the tray, the remaining items in the tray will automatically be biased toward the forward position. It should be noted that the front wall 110 has a plurality of cutouts 111 so that the front face of the product to be dispensed, such as potato chips, is clearly in the view of the purchaser.

FIGS. 21–30 illustrate a further modified form of the invention. In this embodiment, the tray system 200 includes a front wall 202, a rear wall 204 and side walls 206. The tray system is supported on support plates 210 having hooks 211 with support plates 210 extending forwardly and supporting the side walls 206 through rail means, such as described above. The support means also includes a cross-bar 212 that extends parallel to the front wall of the tray system and has opposite ends connected to support plates 210.

The front and rear walls 202 and 204 of the tray system or frame structure for the trays have upwardly-opening slots 214 and 216 that extend along an inner edge of the entire length thereof. The frame structure 200 is divided into a plurality of trays by a plurality of bottom wall segments 220 (FIG. 27) which have downwardly-depending projections 222 at opposite ends which are received into the slots 214 and 216 and are frictionally retained by longitudinal ribs 222*a*.

The respective wall segments have a plurality of rectangular openings 223 at opposite ends thereof. A plurality of partitions or dividers 224 have projections 226 at opposite ends thereof which are received into the respective openings or holes 223 and are retained therein by interference projections 226*a*. The bottom wall segments 220 are spaced from each other to define elongated spaces or slots 230 that extend between the front and rear walls of the frame structure 200. Thus, the two respective adjacent pairs of wall segments and the accompanying partitions or dividers define a plurality of trays that are transversely spaced from each other.

Figure 27:
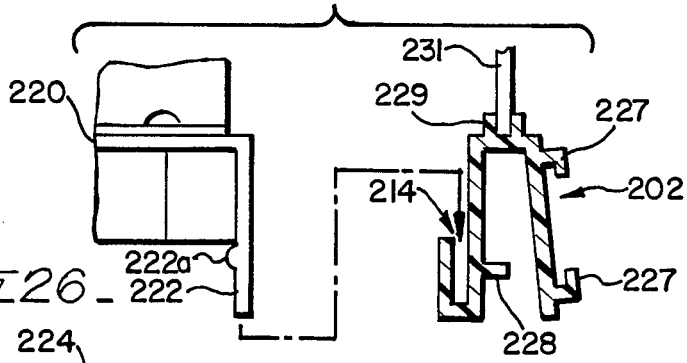
FIG. 27 is a modified form of partition support means.
Figure 26:
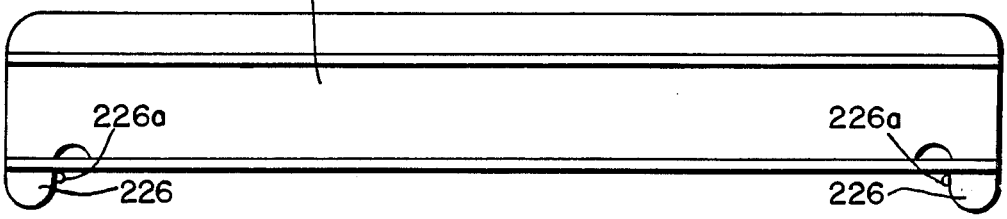
FIG. 26 is a side view of one of the partitions used in the system of FIG. 21.

As illustrated in FIG. 27, the front wall 204 is generally U-shaped in cross-section and has flanges 227 defining a slot for receiving pricing information. The U-shaped front wall has a flange 228 extending from the rear wall surface to define a space for supporting a reinforcing bar (not shown).

A pair of upwardly-directed flanges 229 define an upwardly-opening slot which receives a front wall partition 231. An inner surface of the slot 214 may also have a longitudinal groove (not shown) for receiving the rib 222*a* to retain the projection in the groove.

Figure 22:
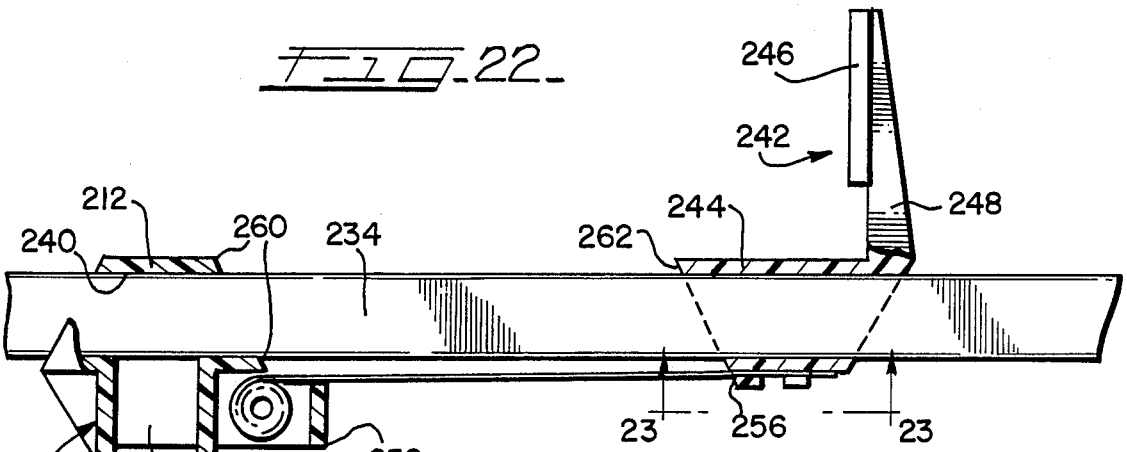
FIG. 22 is a fragmentary cross-sectional view as viewed along line 22—22 of FIG. 21 with partially extended.

A guide rail 234 is located in each of the spaces 230 defined in the respective trays and has projections 236 at opposite ends thereof that are respectively received into the front and rear slots 214 and 216. Each of the guide rails or tracks 234 extends through an opening 240 defined on an insert 241 supported on the cross-bar 212 and slidably supports a pusher plate means 242 (FIG. 22). The pusher plate means consists of a cradle structure or base 244, which is slidably supported on the rectangular plastic guide rail or tube 234 and has a pusher plate 246 connected to an upstanding arm 248.

Figure 23:
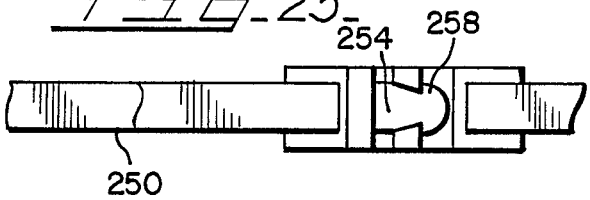
FIG. 23 is a fragmentary view as viewed along line 23—23 of FIG. 22.

The pusher plate means 242 is biased towards the cross-bar 212 through a biasing means 250 which is supported in a housing 252 defined in insert 241. The biasing means is in the form of a coil spring that has its free end 254 extending through a slot 256 defined on the lower surface of the base 244 and has an end portion 258 which may be crimped to secure the end of the spring to the base 244, as shown in FIG. 23.

Insert 241 has an inclined abutment 260 which corresponds to the front surface 262 of the cradle 244 and the biasing means or constant-force coil spring 250 will bias a surface 262 of base 244 into engagement with the abutment so that the pusher plate means 242 is normally in the forward position when no product is located within the respective trays.

Figure 25:
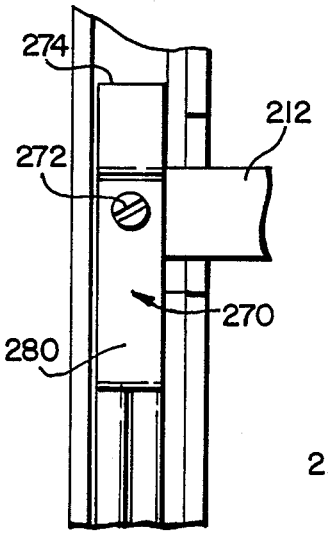
FIG. 25 is a partial bottom view of the tray rack illustrating the latch mechanism.
Figure 24:
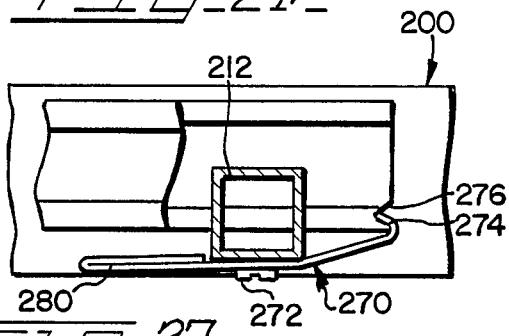
FIG. 24 is a fragmentary cross-sectional view showing the latch mechanism.

According to one aspect of this embodiment of the invention, the dispensing unit incorporates a latch mechanism for maintaining the tray system 200 in a product dispensing position with respect to the support structure. As shown in FIGS. 24 and 25, the latch mechanism consists of a metal strap 270 that is pivotally supported on the forward cross-bar 212 by a screw 272.

positioned substantially to the rear of said trays when said member is moved to said second position.

11. A product dispensing apparatus as defined in claim 1, wherein said latch means is disposed between said support means and said tray.

12. A product dispensing apparatus as defined in claim 1, in which said tray includes a member having front, side and rear walls with slot means adjacent said front and rear walls and a pluralirty of partitions having projections received into said slot means to define a plurality of side-by-side trays.

13. A product dispensing apparatus as defined in claim 12, in which said guide means includes a bar in each tray and having projections on opposite ends received into said, slot means and in which said pusher plate means are slidably supported on said bars.

14. A product dispensing apparatus as defined in claim 12, in which said slot means are continuous in said front and rear walls so that said partitions are infinitely adjustable.

15. A product dispensing apparatus as defined in claim 12, further including a plurality of bottom wall segments having projections at opposite ends received into said slot means with opposite ends of said wall segments having spaced openings and said partitions having projections at opposite ends received into said openings.

16. A product dispensing apparatus comprising a fixed support means having a tray system supported thereon, said tray system being movable between a first dispensing position substantially coextensive with said support means and a second restocking position extending forwardly and outwardly of said support means, said tray system including a member having a bottom wall, a front wall and a rear wall with partitions extending between said front wall and said rear wall to define a plurality of trays, said bottom wall having an elongated slot in each of said trays, a pusher plate means slidably supported in each of said slots with each pusher plate means being movable independently, biasing means between each pusher plate means and said support means for biasing said pusher plate means toward said front wall when said tray system is in said first position, and stop means on said support means for restraining movement of all of said pusher plate means with said tray when said tray system is moved to said second position so that new products can be introduced behind existing products in the trays.

17. A product dispensing apparatus as defined in claim 16, in which said support means includes a bar extending across said tray system adjacent said front wall and support rails extending rearwardly of said bar on opposite sides of said tray system, and in which said tray system has rails cooperating with said support rails for slidably supporting said tray system on said support means.

18. A product dispensing apparatus as defined in claim 17, in which said bottom wall has an abutment adjacent said front wall and latch means on said bar engaging said abutment to secure said tray system on said support means.

19. A product dispensing apparatus as defined in claim 18, in which said latch means includes a cantilevered hook extending from said bar.

20. A product dispensing apparatus as defined in claim 16, in which said support means includes a cross-bar adjacent said rear wall and a plurality of guide bars extending forwardly of said cross-bar and aligned with respective slots and in which respective pusher plate means extend through said slots and are slidably supported on respective guide bars.

21. A product dispensing apparatus as defined in claim 20, further including latch means between said cross-bar and said tray system for securing said tray system in said first dispensing position.

22. A product dispensing apparatus comprising a tray system including a front wall, a rear wall and interconnecting side walls, with said front and rear walls having upwardly-opening slot means adjacent an inner edge thereof, support means for slidably supporting said tray system between a first dispensing position and a second restocking position extending forwardly and outwardly of said support means, a plurality of partitions extending between said front and rear walls to divide said tray system into a plurality of trays, a plurality of guide bars having projection means on opposite ends received into said slot means with a pusher plate means slidably supported on each guide bar, biasing means between said support means and each pusher plate means for biasing said pusher plate means toward said front wall, and stop means on said support means for restraining movement of all of said pusher plate means with said tray when said tray system is moved from said dispensing position to said restocking position so that existing products remain adjacent said front wall and new products can be introduced behind the existing products.

23. A product dispensing apparatus as defined in claim 22, in which said support means includes a cross-bar having rails extending rearwardly at opposite ends with said rails located adjacent said side walls and guide means between said rails and said side walls for slidably supporting said side walls on said rails.

24. A product dispensing apparatus as defined in claim 22, in which said slot means are continuous slots in said front and rear walls.

25. A product dispensing apparatus as defined in claim 23, in which said biasing means includes a spring for each pusher plate means supported on said cross-bar and having a free end connected to said pusher plate.

26. A product dispensing apparatus as defined in claim 24, further including transversely-spaced bottom wall segments having projections received into said slot means with said partitions supported on said bottom wall segments.

27. A product dispensing apparatus as defined in claim 26, in which said bottom wall segments have openings at opposite ends with said partitions having projections received into said openings.

* * * * *

The strap 270 has a hook portion 274 adjacent one end thereof which is adapted to mate with a notch 276 defined on the tray system 200. The strap 270 is configured to contain more weight at an end 280 opposite the end of the hook so that the latch is normally pivoted to a position wherein the hook is in its uppermost position, for a purpose to be described later.

Considering now the assembly and operation of the dispensing unit disclosed in FIGS. 21–30, the various bottom wall segments 220 are first inserted onto the frame structure 200 with projections 222 (FIG. 27) received into the slots 214 and 216. The bottom wall segments are positioned to define the desired spacing for the slots 230 and the partitions are then assembled by inserting the projections 226 at opposite ends thereof into a selected pair of holes 223. Thereafter, the guide bar assembly and pusher plate means are inserted into the centers of the slots 230 with the projections 236, similar to projections 222, at opposite ends thereof being received into the slots 214 and 216. In the assembled condition illustrated in FIG. 21, the tray system defines a plurality of side-by-side trays.

Figure 28:
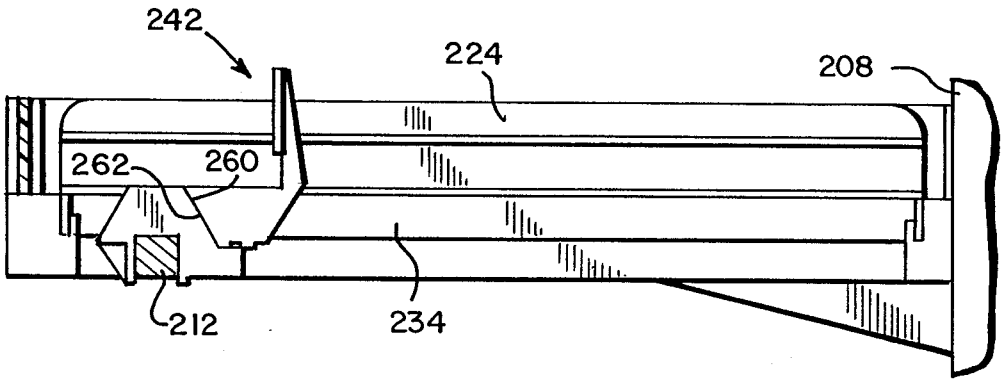
FIGS. 28, 29 and 30 are side views showing the relative positions of the elements in the restocking and dispensing positions.
Figure 29:
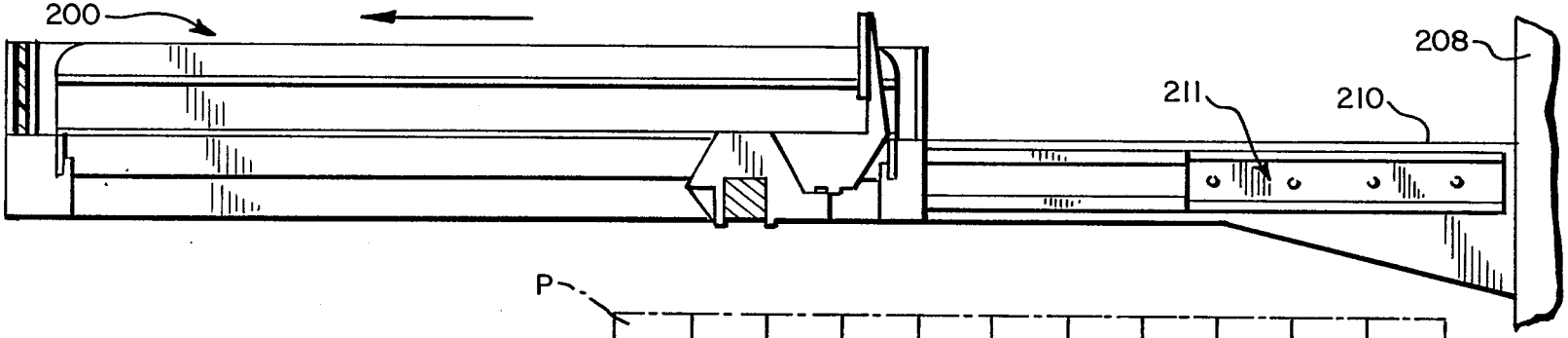
Figure 30:
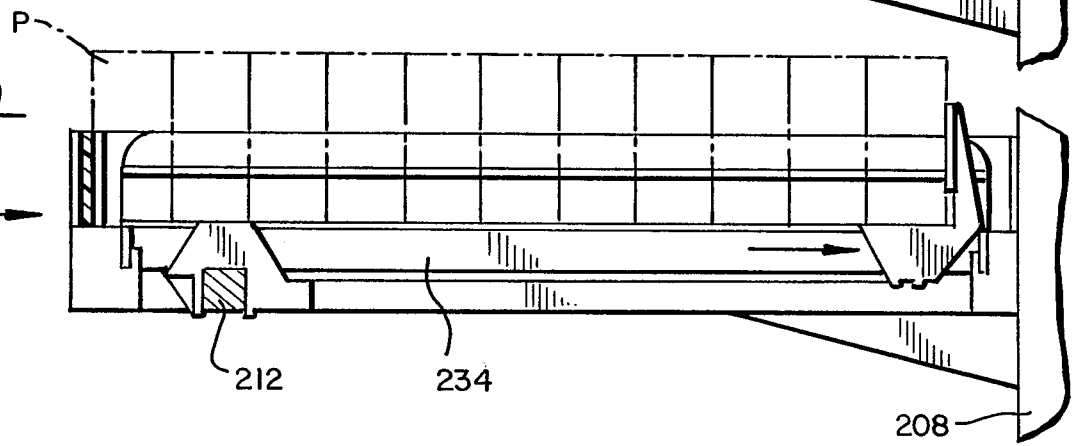

FIG. 28 illustrates the initial position of the product dispensing unit prior to insertion of any product therein and it will be noted that the biasing means 250 biases the pusher plate means 242 towards the cross-member 212 so that the surface 262 engages the abutment 260. When it is desired to insert the product into the display unit, the latch 270 (FIG. 24) is engaged on the weighted end 280 to pivot the latch so that the hook 274 is moved out of engagement of the notch 276. The tray assembly 200 is then moved to a second product restocking position shown in FIG. 29. During this movement the pusher plate means 242 are all moved from the forward end to the rearward end of the tray assembly, as shown in FIG. 29. The product P is then inserted into the tray while the assembly is in the position shown in FIG. 29 and upon replenishment of the product in all of the trays, the tray assembly is moved or returned to its first product dispensing position, illustrated in FIG. 30. During such movement, the pusher plate means 242 will engage the rear-most article or product P and be forced rearwardly along track or guide rail 234. As the tray system is returned to its product dispensing position, the surface of the hook will slide along the bottom surface of the tray system 200 and, when in the final dispensing position, the weight of the weighted end 280 will pivot the hook so that it engages the notch 276 to hold the tray system in the product dispensing position.

With the system so far described, the display unit has great versatility and allows for the restocking of new product behind the old product without removal of the existing stock in a particular tray. Furthermore, the system, particularly the embodiment shown in FIGS. 21–30, has great versatility in that the width of the trays are readily adjustable to accommodate different sized products. Also, there is no need for gaining access to the rear of the display, which is particulary important in modern-day grocery stores which have gondola shelving oriented in a back-to-back fixed fashion.

Numerous modifications are apparent. For example, partitions 224 could be formed as an integral part of the bottom segments 220 rather than being adjustable thereon as described. Furthermore, a single partition could be utilized for defining opposite sides of adjacent trays rather than separate partitions, as illustrated in the drawings. In certain instances, the bottom wall segments could be eliminated and the partitions could be supported directly in the slot means.

While specific embodiments have been illustrated and described, numerous modifications come to mind without significantly departing from the spirit of the invention and the scope of protection is only limited by the scope of the accompanying claims.

We claim:

1. A product dispensing apparatus comprising a fixed support means and a tray slidably supported thereon and movable from a product dispensing first position substantially coextensive with said support means to a second product replenishing position extending forwardly away from said support means, said tray having a front end and a rear end, guide means extending along a bottom portion of said tray between said front end and said rear end, pusher plate means slidably mounted in said guide means, biasing means between said support means and said pusher plate means for biasing said pusher plate means towards said front end, latch means adjacent said front wall for maintaining said tray in said first position, and stop means on said support means for restraining movement of said pusher plate means with said tray when said tray is moved from said first position to said second position.

2. A producing dispensing apparatus as defined in claim 1, in which said support means includes a cross-bar adjacent a forward end of said tray defining said means on said support means.

3. A product dispensing apparatus as defined in claim 2, in which said guide means includes a slot in said bottom of said tray and having opposite edges with said pusher plate means slidably supported on said edges.

4. A product dispensing apparatus as defined in claim 2, in which said biasing means includes a spring supported on said pusher plate means and having a free end connected to said cross-bar.

5. A product dispensing apparatus as defined in claim 2, in which said tray includes a one-piece molded member having a front wall, a rear wall and side walls with transversely-spaced partitions extending between said front and rear walls to define a plurality of spaced trays.

6. A product dispensing apparatus as defined in claim 1, in which said support means includes a cross-member having a plurality of fixed transversely-spaced guide tracks extending parallel to each other with said tray including a member having transversely-spaced partitions defining a plurality of trays respectively slidably supported on said guide tracks with a pusher plate means slidably supported in each tray.

7. A product dispensing apparatus as defined in claim 6, in which said biasing means includes coil springs carried by said pusher plate means and having free ends secured to free ends of said guide tracks.

8. A product dispensing means as defined in claim 7, in which said member has elongated slots in each of said trays and aligned with said guide tracks with said pusher plate means extending through said slots and slidably supported on said guide tracks.

9. A product dispensing apparatus as defined in claim 8, in which said member has elongated channels extending below said slots and surrounding said guide tracks.

10. A product dispensing apparatus as defined in claim 8, in which said trays are of different lengths and have rear ends substantially aligned, and further including means for controlling the movement of said pusher plate means so that all of said pusher plate means are